United States Patent [19]

Stumpp et al.

[11] 4,090,487

[45] May 23, 1978

[54] FUEL INJECTION SYSTEM

[75] Inventors: Gerhard Stumpp; Hermann Grieshaber, both of Stuttgart, Germany

[73] Assignee: Robert Bosch GmbH, Stuttgart, Germany

[21] Appl. No.: 722,209

[22] Filed: Sep. 10, 1976

[30] Foreign Application Priority Data

Oct. 7, 1975 Germany ..... 2544810

[51] Int. Cl.[2] ..... F02D 1/06; F02M 39/00

[52] U.S. Cl. ..... 123/140 MP; 123/140 MC; 123/139 AW; 123/119 R; 261/50 A

[58] Field of Search ..... 123/139 AW, 140 MC, 123/119 R, 140 MP; 261/50 A

[56] References Cited

U.S. PATENT DOCUMENTS

| | | | |
|---|---|---|---|
| 2,957,467 | 10/1960 | Ball | 123/139 AW |
| 3,750,636 | 8/1973 | Okura | 123/139 AW |
| 3,866,583 | 2/1975 | Pundt et al. | 123/139 AW |
| 3,927,649 | 12/1975 | Stumpp | 123/139 AW |
| 3,983,856 | 10/1976 | Stumpp et al. | 123/139 AW |

*Primary Examiner*—Charles J. Myhre
*Assistant Examiner*—Parshotam S. Lall
*Attorney, Agent, or Firm*—Edwin E. Greigg

[57] ABSTRACT

A fuel injection system for externally ignited internal combustion engines in which a fuel metering and distributing valve is controlled by an air sensing element disposed in the air suction tube of the engine and by structure which is adapted to alter the restoring force exerted on the air sensing element through the fuel metering and distributing valve. The noted structure includes a control pressure conduit, a pressure control valve connected to the control pressure conduit and further conduits for connecting the pressure control valve to the suction tube of the engine downstream of the butterfly valve and between the air sensing element and the butterfly valve. With this structure it is possible to alter the restoring force mentioned above so that a properly proportioned fuel - air mixture is achieved for various load changes of the internal combustion engine.

7 Claims, 2 Drawing Figures

FUEL INJECTION SYSTEM

BACKGROUND OF THE INVENTION

The present invention relates to a fuel injection system for an externally ignited internal combustion engine. The system according to the present invention operates on fuel which is continuously injected into the suction tube of the engine in which a sensing element and an arbitrarily operable butterfly valve are disposed in series. The sensing element is displaced by and in proportion to the quantity of air flowing through the suction tube against a restoring force. In the course of its excursion, the sensing element displaces a movable component of a valve which is disposed in the fuel supply line for metering a quantity of fuel which is proportionate to the quantity of air. The above noted restoring force is supplied by liquid under pressure which is delivered continuously under constant, but arbitrarily variable pressure through a control pressure line. The pressurized liquid exerts a force on a control plunger transferring the restoring force. The pressure of the pressurized liquid is variable by at least one pressure control valve controllable as a function of the engine parameters. The pressure control valve preferably takes the form of a flat seat valve comprising a valve membrane (diaphragm) as the movable valve part.

Fuel injection systems of this type are designed to automatically provide a good fuel - air mixture for all operating conditions of the internal combustion engine so as to burn the fuel as completely as possible and thus prevent toxic gases from being produced, or at least to considerably reduce the same while obtaining maximum performance of the internal combustion engine with minimum fuel consumption. The quantity of fuel must, therefore, be very accurately metered in accordance with the requirements of each operating state of the internal combustion engine.

In the case of known fuel injection systems of this type, the quantity of fuel which is metered is, as far as possible, proportionate to the quantity of air flowing through the suction tube. The ratio of the quantity of fuel which is metered to the quantity of air may be varied by changing the restoring force of the sensing element as a function of the operating parameters by means of a control valve.

It has been found that it is advantageous to momentarily enrich the fuel - air mixture when the butterfly valve of the internal combustion engine is suddenly opened.

OBJECTS AND SUMMARY OF THE INVENTION

The principal object of the present invention is to provide a fuel injection system of the known type, wherein the fuel - air mixture is momentarily enriched during load changes of the internal combustion engine.

This object and others are accomplished according to the present invention in that for the purpose of changing the fuel - air ratio during load changes, a pressure control valve is provided which comprises two pressure chambers separated by a control membrane and in communication with one another via a throttle bore. The first of these pressure chambers is in communication with the suction tube downstream of the throttle valve via a pressure line, and with the suction tube between the sensing element and the butterfly valve via a throttle opening, a spring chamber and a further pressure line. A control spring acting on the control membrane is disposed in the second chamber and a valve spring acting on another membrane (valve membrane) is disposed in the spring chamber. A transmission pin is disposed between the valve membrane and the control membrane.

An advantageous feature of the invention consists in that a full load spring which rests, on the one hand, on the control diaphragm and, on the other hand, on a full load diaphragm separating the second pressure chamber from a third pressure chamber, is disposed in the second pressure chamber, the third pressure chamber being connected to the suction pipe between the sensing element and the butterfly valve.

Other features and advantages of the present invention will be made apparent in the following description of preferred embodiments thereof provided with reference to the accompanying simplified drawings.

DESCRIPTION OF THE PREFERRED EMBODIMENTS

Figure 1:
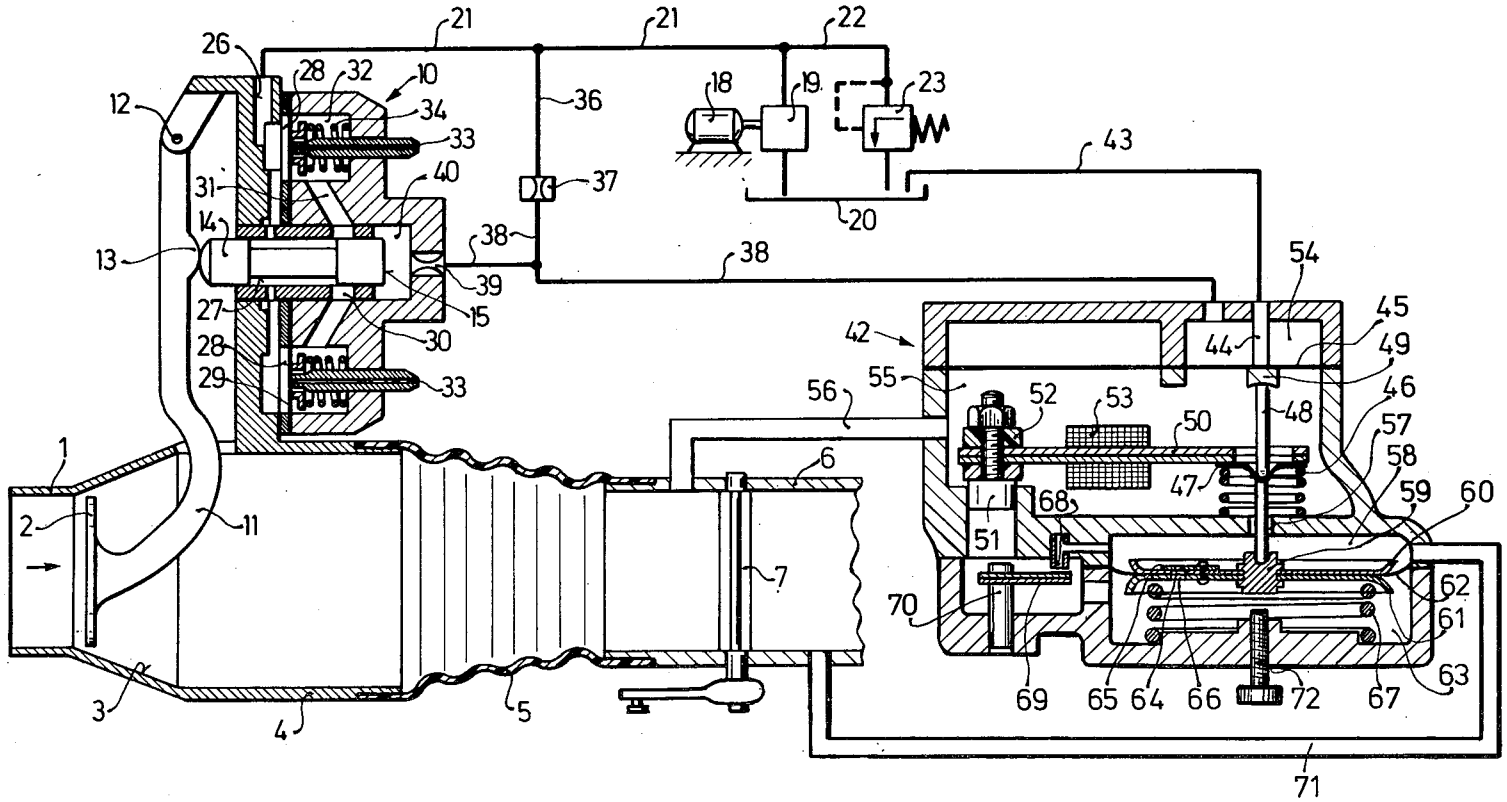
FIG. 1 illustrates a first embodiment of the fuel injection system according to the present invention.

In the fuel injection system represented in FIG. 1, the combustion air flows in the direction of the arrow through a suction tube portion 1 past a sensing element or air sensor 2 disposed in a conical portion 3. From the conical portion 3, the air flows through a suction tube portion 4 and thereafter through a coupling hose 5 into a suction tube portion 6 in which there is disposed an arbitrarily operable butterfly valve 7. From the latter the combustion air flows to one or more cylinders (not shown) of an internal combustion engine. The air sensor 2 consists of a plate disposed at right angles to the direction of air flow and is displaced in the conical suction tube portion 3 as an approximately linear function of the air flowing through the suction tube. Given a constant restoring force exerted on the air sensor 2 as well as a constant pressure prevailing upstream of the air sensor 2, the pressure prevailing between the air sensor 2 and the butterfly valve 7 also remains constant.

The air sensor 2 directly controls a fuel metering and distributing valve 10. For the transmission of the motion of the air sensor 2 there is provided a lever 11 which is connected to the air sensor at one end and pivotably mounted on a pivot pin 12 at the other end. The lever 11 is provided with a nose 13 and during the pivoting movement of the lever, the nose 13 actuates a movable slide member 14 of the fuel metering and distributing valve 10. The slide member 14 serves as a control plunger including a front face 15 remote from the nose 13. The front face 15 is exposed to the force of the pressurized liquid. The pressure of this liquid acting on the face 15 produces the restoring force on the air sensor 2.

Fuel is supplied by means of a fuel pump 19 which is driven by an electric motor 18 and which draws fuel from a fuel tank 20 and delivers it through a conduit 21 to the fuel metering and distributing valve 10. From the conduit 21 there extends a conduit 22 in which there is disposed a pressure limiting valve 23. When there is excessive pressure in the system the pressure limiting valve allows fuel to flow back into the fuel tank 20.

From the conduit 21 the fuel is admitted into a channel 26 provided in the housing of the fuel metering and distributing valve 10. The channel 26 leads to an annular groove 27 off the control plunger or slide member 14 and further leads through several branch conduits to the chambers 28, such that the one side of a membrane 29 is exposed to fuel pressure. Dependent upon the axial position of the slide member 14, the annular groove 27 opens to a greater or lesser extent control slots 30 which lead, through channels 31, to chambers 32. Each of the latter is separated from a corresponding chamber 28 by means of the membrane 29. From the chambers 32 the fuel is admitted through injection channels 33 to the individual fuel injection valves (not shown) which are positioned in the suction tube in the vicinity of a corresponding engine cylinder. The membrane 29 serves as the movable part of a flat seat valve which, when the fuel injection system is inoperative, is maintained open by means of a spring 34. The membrane boxes, each formed of a chamber 28 and 32, ensure that, independently of the overlap between the annular groove 27 and the control slots 30, that is, independently of the quantity of fuel flowing to the fuel injection valves, the pressure drop at the fuel metering valves 27, 30 remains substantially constant. In this way, it is ensured that the extent of displacement of the slide member 14 and the metered fuel quantity are proportionate to one another.

Upon a pivotal movement of the lever 11, the air sensor 2 is moved in the conical portion 3 of the suction tube and, as a result, the annular flow passage section between the air sensor 2 and the cone changes in porportion to the extent of the displacement of the air sensor 2.

The liquid producing the constant restoring force on the slide member 14 is fuel. For this purpose, from the conduit 21 there extends a conduit 36 which is separated from a pressure control conduit 38 by means of an uncoupling throttle 37. A pressure chamber 40 communicates with the control conduit 38 via a damping throttle 38. The front face 15 of the slide member 14 projects into the pressure chamber 40.

A pressure control valve 42 is disposed in the control pressure conduit 38. The pressurized fluid can pass to the fuel tank 20 through a depressurized return conduit 43 via the pressure control valve 42. The pressure control valve 42 is in the form of a flat seat valve having a stationary valve seat 44 and a valve membrane 45 which is biased in the closing direction of the valve, inter alia, by a spring 46. The valve spring 46 exerts pressure on the valve membrane 45 via a sring rest 47 and a transmission or valve pin 48 which is connected to the latter and which is supported on a bearing seat 49. At temperatures below the engine operating temperature the closing force transmitted to the pressure control valve 42 by the valve pin 48 works against a bi-metallic spring 50 which, during the warm-up stage, rests at its one end against the spring rest 47. The other end of the spring 50 is secured by means of a bolt 51, which is pressed into the housing of the pressure control valve 42. The bi-metallic spring 50 is largely protected against losing heat to the housing of the pressure control valve by means of an insulating element 52 disposed between the bolt 51 and the bi-metallic spring 50. An electric heating element 53, which is energized in a conventional manner, is mounted on the bi-metallic spring 50.

The valve membrane 45 separates a control pressure chamber 54 from a spring chamber 55. The spring chamber 55 is connected to the suction tube between the air sensor 2 and the butterfly valve 7 by a conduit 56. The transmission pin 48 disposed in the spring chamber 55 projects with its end remote from the valve membrane 45 through a throttle opening 57 into a first pressure chamber 58. The throttle opening 57 is disposed in the wall of the pressure control valve 42 limiting the spring chamber 55, and its diameter is such as to permit the friction-free displacement of the pin 48. In the first pressure chamber 58 the pin 48 rests on a connecting element 59 which connects two spring rests 60, 61 with a control membrane 62 separating the first pressure chamber 58 from a second pressure chamber 63. The second pressure chamber 63 is connected to the first pressure chamber via a throttle bore 64. In the embodiment illustrated, the throttle bore 64 is disposed in a blade valve 65. The blade valve 65 is attached to the spring rest 60 and is designed to open towards the first pressure chamber 58. The blade valve 65 cooperates with a valve opening 66. A control spring 67 acting on the control membrane 62 via the spring rest 61 is disposed in the second pressure chamber 63.

Contrary to that which is shown in FIG. 1, the throttle bore 64 can also be provided directly in the control membrane 62. A compensating bore 68 controllable by a temperature or time-dependent element is disposed parallel to the throttle bore 64. The temperture-dependent element can consists, for exaple, of a bi-metallic spring 69 which completely opens the compensating bore 68 upon termination of the warm-up stage. The bi-metallic spring 69 can be heated through direct heating contact with the internal combustion engine or by an electric heating element. The end of the bi-metallic spring 69 remote from the compensating bore 68 is connected to a bolt 70 pressed into the housing of pressure control valve 42.

The first pressure chamber 58 communicates, on the one hand, with the suction tube portion 6 downstream of the throttle valve 7 via a pressure line 71 and, on the other hand, with the spring chamber 55 via the throttle opening 57. The diameter of throttle opening 57 is sufficiently small for the idling rate to be kept adequately low. The displacement of the control membrane 62 can be limited by the abutment of the connecting element 59 against a stop 72 which can consist, for example, of a screw and which can be arbitrarily adjustable.

The fuel injection system shown in FIG. 1 operates in the following manner:

when the internal combustion engine is running, fuel is drawn from the tank 20 by the pump 19 driven by the electric motor 18 and forced through the conduit 21 to the fuel metering and distributing valve 10. At the same time, the internal combustion engine draws air through the suction tube 1 and, as a result, the air sensor 2 undergoes a certain excursion from its rest position. In response to the deflection of the air sensor 2, the slide member 14 is displaced via the lever 11 and thus the flow passage section at the control slots 30 is increased. The direct connection between the air sensor 2 and the slide member 14 ensures a constant ratio between the quantity of air and the metered quantity of fuel provided the characteristics of these two components are sufficiently linear (which is desideratum by itself). In such a case, the fuel - air ratio would be constant for the entire operational range of the engine. However, it is necessary for the fuel - air mixture to be richer or leaner depending on the operational conditions and this is achieved by varying the restoring force acting on the air sensor 2. For this purpose there is provided in the control pressure conduit 38 the pressure control valve 42 which, by influencing the pressure of the pressurized liquid during the warm-up stage of the internal combustion engine, influences the fuel-air ratio as a function of the temperature and during load changes, until the operating temperature of the internal combustion engine is reached. The control pressure is determined by the closing force transmitted to the valve membrane 45 by the valve pin 48. However, at temperatures below the operating temperature of the internal combustion engine the bi-metalic valve spring 50 acts on the spring rest 47 against the force acting on the pin 48 thereby reducing the closing force exerted on the membrane 45. However, immediately after the engine is started, the bi-metallic valve spring 50 is heated by means of the electric heating element 53 which results in a reduction in the force transmitted by the bi-metallic spring 50 against the spring rest 47. The requisite initial biasing of the spring 50 can be achieved by pressing the bolt 51 to a varying depth in the housing of the pressure control valve 42.

When the internal combustion engine is suddenly accelerated, according to the present invention, the pressure of the pressurized fluid in the control pressure conduit 38 is reduced for the purpose of obtaining an acceleration fuel quantity in addition to the quantity of fuel metered at the metering and distributing valve 10 independence on the quantity of air drawn in, thus enabling a richer fuel-air mixture to be obtained. As a result of a reduction of the pressure of the pressure liquid in the control pressure conduit 38, the restoring force exerted on the air sensor 2 is reduced and, as a result, while the throughgoing quantity of air remains constant, the deflection of the air sensor 2 and thus of the slide member 14 is more extensive, whereupon an increased quantity of fuel is metered at the metering valve 27, 30.

The reduction in the pressure of the pressure liquid in the control pressure conduit 38 occurs as a result of the fact that when there is a sudden acceleration of the internal combustion engine the pressure in the suction tube portion 6 downstream of the throttle valve 7, increases, thereby producing a pressure difference at the control membrane 62. This pressure difference results in a reduction of the force of the control spring 67 on the transmission pin 48 and thus of the closing force exerted on the membrane 45. The acceleration enrichment is temporally limited by the selection of the cross-section of the throttle bore 64, by means of which pressure equalization can be produced between the first pressure chamber 58 and the second pressure chamber 63. The volume of the second pressure chamber 63 serves as a further factor which can determine the period of enrichment. The time factor can also be varied by virtue of the fact that a compensation hole 68 is disposed parallel to the throttle bore 64. This compensation hole 68 is opened fully by the bi-metallic spring 69 upon termination of the warm-up stage of the internal combustion engine; acceleration enrichment decreaasing as the engine continues to warm-up.

The blade valve 65 which opens when the pressure in the second pressure chamber 63 is higher than the pressure in the first pressure chamber 58, serves to prevent the control pressure in the control pressure line 38 and thus to prevent the fuel - air mixture from becoming leaner when the butterfly valve 7 is closed.

Figure 2:
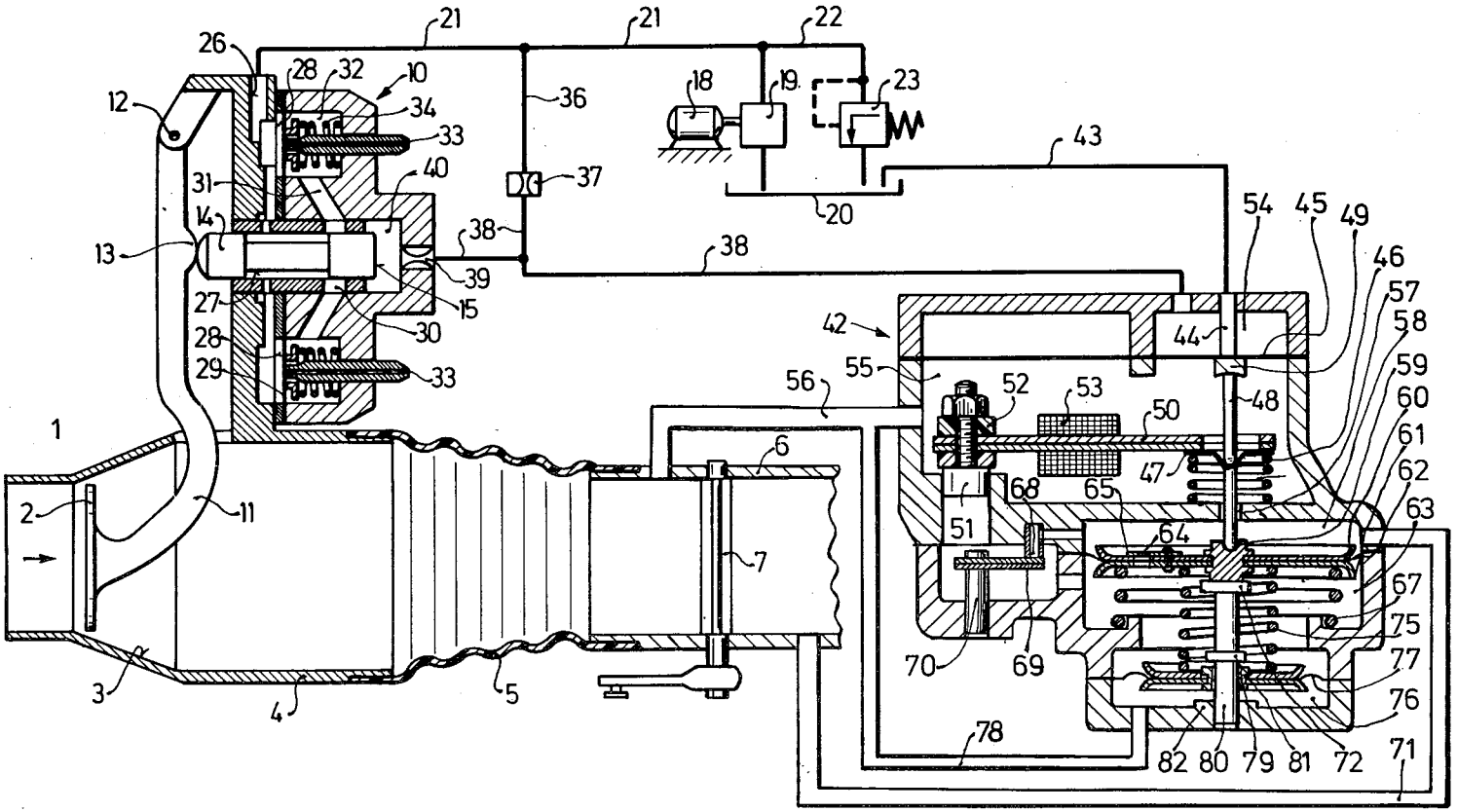
FIG. 2 illustrates a second embodiment of the fuel injection system according to the present invention.

In the fuel injection system shown in FIG. 2, the corresponding parts to those of FIG. 1 have been designated by the same reference numbers. In addition to the acceleration enrichment according to the first embodiment in FIG. 1, the embodiment according to FIG. 2 also permits full load enrichment. For this purpose a full load spring 75 is disposed in the second pressure chamber 63. The full load spring 75 rests, on the one hand, on the control membrane 62 and on the other hand, on a full load membrane 77 separating the second pressure chamber 63 from a third pressure chamber 76; the latter being connected to the suction tube 4, 5 between the air sensor 2 and the butterfly valve 7 by a pressure line 78. The full-load membrane 77 slides on a bolt 80 by means of a guide bushing 79. The bolt 80 bears the stop 72 for the control membrane 62 and a stop 81 for the full load membrane 77 whose movement is limited on the other side by a stop 82. In the full-load position of the butterfly valve 7 and thus with a small pressure drop at the butterfly valve the full-load membrane 77 rests against the stop 82, such that the force of the full-load spring 75, and thus the closing force on the valve membrane 45, is reduced. By reducing the control pressure in the control pressure line 38, an enrichment of the fuel - air mixture is obtained.

What is claimed is:

1. A fuel injection system for externally ignited internal combustion engines comprising, in combination:

a. a suction tube for air intake to the engine;
b. an air sensor disposed in said suction tube;
c. an arbitrarily operable butterfly valve disposed in said suction tube in series with said air sensor;
d. a fuel supply conduit;
e. a control pressure conduit;
f. a fuel metering valve connected to said fuel supply conduit and said control pressure conduit for continuously injecting fuel into said suction tube;
g. a control plunger; serving as the movable member of said fuel metering valve, said control plunger being acted upon on one end by said air sensor, and on an opposite end by a return force provided by liquid under constant but arbitrarily variable pressure delivered by said control pressure conduit, for metering a fuel quantity that is proportionate to the quantity of air measured by said air sensor; and
h. at least one pressure control valve in the form of a flat seat valve having a membrane as the movable valve part, said pressure control valve being disposed in said control pressure conduit for varying pressure in said control pressure conduit in dependence on at least one operating parameter of the engine and thereby varying the fuel-air ratio during load changes wherein said pressure control valve includes:
   (i) a valve membrane;
   (ii) a control membrane;
   (iii) two pressure chambers separated from one another by said control membrane;
   (iv) means defining a throttle bore within the pressure control valve for connecting the pressure chambers;
   (v) a pressure conduit connected to a first one of the pressure chambers and to the suction tube downstream of the butterfly valve;
   (vi) a spring chamber;
   (vii) means defining another throttle bore within the pressure control valve for connecting the spring chamber to the first one of the pressure chambers;

(viii) a further pressure conduit connected to the spring chamber and to the suction tube between the air sensor and the butterfly valve;

(ix) a control spring disposed in the second one of the pressure chambers, said control spring acting against the control membrane;

(x) a valve spring disposed in the spring chamber, said valve spring acting against the valve membrane; and (xi) a transmission pin disposed between the valve membrane and the control membrane.

2. The fuel injection system as defined in claim 1, wherein the transmission pin projects through said another throttle bore into the first one of the pressure chambers.

3. The fuel injection system as defined in claim 1, wherein the pressure control valve further includes an electrically heatable bi-metallic valve spring and wherein at temperatures below the operating temperature of the engine, the closing force exerted on the valve membrane can be reduced by means of the electrically heatable bi-metallic spring.

4. The fuel injection system as defined in claim 1, wherein the pressure control valve further includes a compensating hole and a temperture-dependent element disposed parallel to the throttle bore connecting the two pressure chambers, and wherein the compensating hole is controllable by the temperature-dependent element.

5. The fuel injection system as defined in claim 4, wherein the temperature-dependent element comprises a bi-metallic control spring which opens the compensating hole upon termination of the warm-up stage of the engine.

6. The fuel injection system as defined in claim 4, wherein the throttle bore connecting the two pressure chambers is disposed in a blade valve which is attached to the control membrane, said blade valve opening towards the first one of the pressure chambers.

7. The fuel injection system as defined in claim 1, wherein the pressure control valve further includes:

(xii) a full-load membrane;

(xiii) a third pressure chamber separated from the second one of the pressure chambers by the full-load membrane;

(xiv) a full-load spring disposed in the second one of the pressure chambers and applied, on the one hand, against the control membrane, and, on the other hand, against the full-load membrane; and (xv) another pressure conduit connected to the third pressure chamber and to the suction tube between the air sensor and the butterfly valve.

* * * * *